United States Patent [19]

Kuhn et al.

[11] Patent Number: 4,725,250

[45] Date of Patent: Feb. 16, 1988

[54] HIGH DENSITY CIRCUIT PANEL SOCKET

[75] Inventors: Brent A. Kuhn; Gary R. Marpoe, Jr., both of Winston-Salem; James R. Coller, Kernersville, all of N.C.

[73] Assignee: AMP Incorporated, Harrisburg, Pa.

[21] Appl. No.: 6,848

[22] Filed: Jan. 27, 1987

[51] Int. Cl.[4] ..... H01R 13/04

[52] U.S. Cl. ..... 439/629

[58] Field of Search ..... 439/629, 630, 631, 636

[56] References Cited

U.S. PATENT DOCUMENTS

| | | | |
|---|---|---|---|
| 3,366,919 | 1/1968 | Gammel, Sr. et al. | 439/631 |
| 3,732,531 | 5/1973 | Bouley | 439/636 |
| 4,072,376 | 2/1978 | Shannon . | |
| 4,322,120 | 3/1982 | Rilling | 439/631 |
| 4,557,548 | 12/1985 | Thrush . | |
| 4,558,912 | 12/1985 | Coller et al. . | |
| 4,575,172 | 3/1986 | Walse et al. . | |
| 4,577,922 | 3/1986 | Stipanuk et al. . | |

OTHER PUBLICATIONS

U.S. Patent Application Ser. No. #800,181, filed Nov. 20, 1985.

*Primary Examiner*—Joseph H. McGlynn
*Attorney, Agent, or Firm*—Robert W. Pitts

[57] ABSTRACT

A socket connector suitable for use in establishing interconnection to a plurality of closely spaced surface pad portions of traces on a circuit panel is disclosed. This socket connector is suitable for use with a high density single in-line memory module. The individual terminals are edge stamped from a spring metal blank and inserted in closely spaced centerlines and cavities in the housing. Insertion of a circuit panel edgewise into the connector biases the terminals outwardly with the stresses primarily confined to the plane of the spring metal blank. The terminals are inserted from above and positively retained within the housing. Low insertion forces, together with a wiping action between the terminals and the surface pad portions of traces on the circuit panel is achieved.

23 Claims, 9 Drawing Figures

HIGH DENSITY CIRCUIT PANEL SOCKET

BACKGROUND OF THE INVENTION

1. Field of the Invention

This invention relates to a connector for use in establishing an interconnection to surface pads adjacent the edge of a circuit panel substrate upon insertion of the substrate edgewise into the connector and more particularly relates to a connector employing edge stamped terminals.

2. Description of the Prior Art

Single in-line memory modules represent a high density single in-line package for electronic components such as dynamic random access memory integrated circuit components. A plurality of these components can be mounted in line on a circuit panel whose height is little more than the length of the components themselves. The circuit panels can in turn be mounted on a printed circuit board daughter card which can then be mounted on a printed circuit mother card. The spacing between adjacent daughter boards would then need to be only slightly greater than the height of the individual circuit panels or single in-line memory modules. One approach for mounting single in-line memory modules on a daughter board would be to employ plug in leads adjacent one edge of the circuit panel. These plug in leads can then be connected to conventional printed circuit board contacts such as miniature spring sockets. Miniature spring sockets of this type are shown generally in U.S. Pat. No. 4,072,376. Of course, individual miniature spring sockets would be linearly aligned in order to accept plug in contacts on the edge of the circuit panel. Conventional single in-line edge clips can also be employed.

In addition to modules having plug in leads on the edge of the circuit panel, a plug in circuit panel having surface pads on the surface of the panel substrate extending adjacent the edge of the panel can also be employed. These modules can then be inserted into sockets having contacts aligned to establish a spring biased engagement with the pads on opposite surfaces of the circuit panel substrate. Conventional modules having adjacent pads spaced apart on centerlines of 0.100 inch are commonly employed. A single in-line memory module socket suitable for use with such conventional centerline spacings is disclosed in U.S. Pat. No. 4,557,548; U.S. Pat. No. 4,558,912; and U.S. patent application Ser. No. 800,181 filed Nov. 20, 1985. That connector employs stamped and formed terminals to establish a spring biased contact with the surface pad portions of traces on the module circuit panels.

Another socket used with single in-line memory module circuit panels having surface pads adjacent the edges is disclosed in U.S. Pat. No. 4,575,172. That connector employs a C-shaped spring contact which is stamped and integrally formed from a resilient electrical conductive metallic material, such as a strip of beryllium copper having a thickness of approximately 0.015 inch. To establish contact between the terminal and surface pads on a circuit panel, the surface panel must first be inserted between the ends of the C-shaped member without applying force to the spring terminal and then rotated into position. The contact points engaging opposite sides of the circuit panel are offset, thus requiring a separate latch on the housing to hold the circuit panel in place. Since a large number of contacts are employed on a circuit panel having a relatively high aspect ratio, this configuration stresses the circuit panel itself. Over time, this stress may result in significant warpage and damage to the component to circuit panel interconnection and to the socket to circuit panel interconnection. U.S. Pat. No. 4,577,922 discloses a similar contact in which a dielectric layer is deposited on the terminals themselves in an effort to obtain a closer spacing between adjacent terminals.

The instant invention employs terminals edge stamped from a metal blank so that the terminals can be positioned on centerline spacings significantly less than those obtained using the configuration of U.S. Pat. No. 4,558,912. Furthermore, the socket of the instant invention employs terminals which permit insertion of the circuit panels into the socket with a relatively low insertion force. The fact that the insertion force is not equal to zero is an advantage because the surface pads on the circuit panels are wiped during insertion, thus removing contaminates and corrosion from the surface pads. This wiping action promotes establishment of a sound and reliable electrical interconnection. A terminal which can be employed in this connector is disclosed in a copending application Ser. No. 07/006,538 filed on Jan. 23, 1987 entitled "Low Insertion Force Terminal For Use With Circuit Panel".

SUMMARY OF THE INVENTION

The electrical connector disclosed herein is for use in establishing contact with traces on a circuit panel, such as a printed circuit board, or a panel used on a single in-line memory module. This connector comprises an insulative housing having a plurality of terminals positioned within cavities in the housing. These terminal open onto an upper surface of the insulative housing and a circuit panel can be inserted edgewise into the connector so that the terminals engage the surface pad portions of traces on the circuit panel. In the preferred embodiment of this invention, the individual terminals are edge stamped from a spring metal blank. The individual terminals of the preferred embodiment of the invention have opposed cantilever beams extending from an intermediate base. The terminals can be inserted into the cavities in the insulative housing from the top. The terminals are retained in the housing by a protuberance in each cavity. During insertion of the terminals, the intermediate base is bowed or deflected normal to the plane of the terminal to pass over this protuberance and subsequently snaps back into the plane of the contact after passing over this protuberance. The terminals can be inserted into the cavities by the use of an insertion tool which engages the free ends of insertion arms extending upwardly from the base on the ends of each terminal. During insertion, the intermediate base and portions of the insertion arm engage ribs located at the lateral ends of the cavities on an opposite wall of the housing from the central retaining protuberance. These ribs serve to maintain the terminals at a precise position within the housing after insertion.

BRIEF DESCRIPTION OF THE DRAWINGS

FIG. 3 is a plan view of a portion of the central body of the insulative connector showing a pair of side by side terminal receiving cavities.

DETAILED DESCRIPTION OF THE PREFERRED EMBODIMENT

Figure 1:
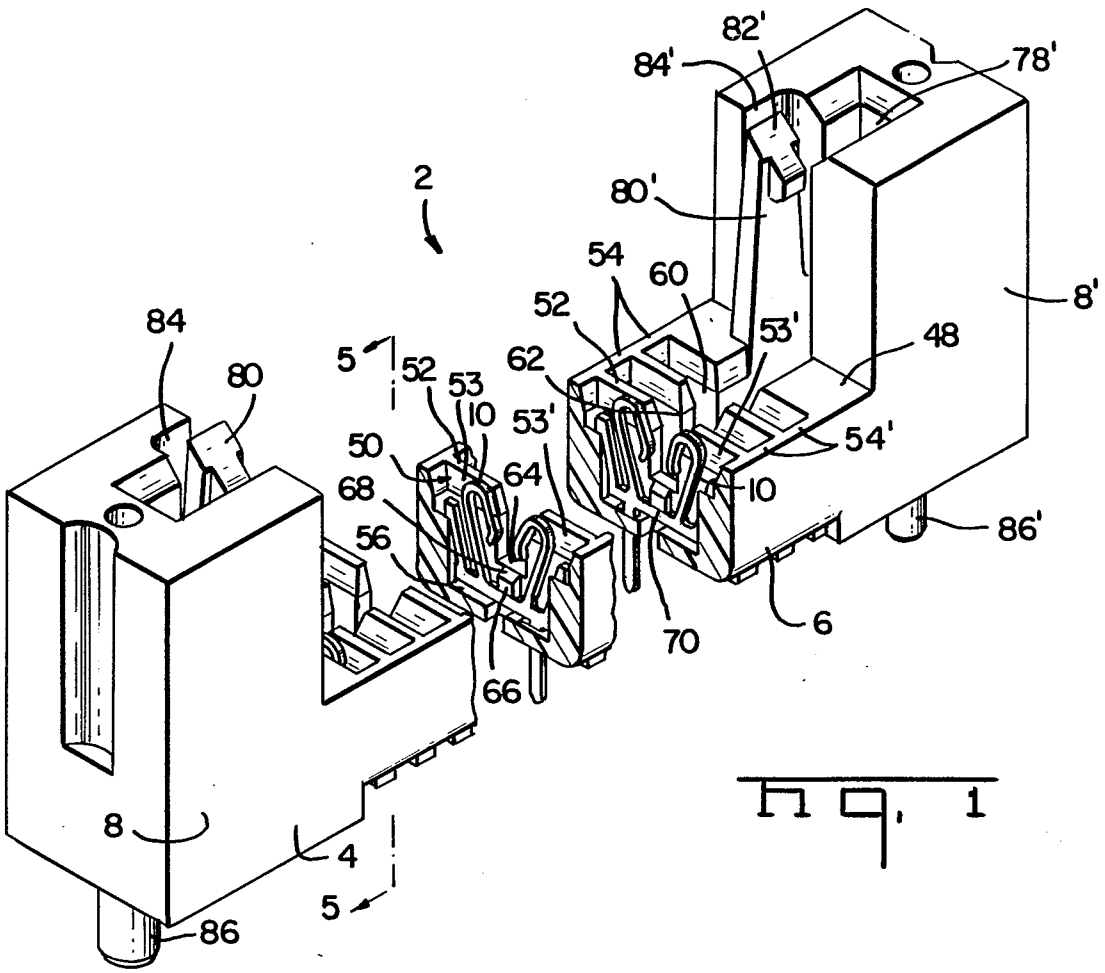
FIG. 1 is a perspective view of a connector, in which portions of the connector are broken away to show the configuration of individual terminals located in the multicontact housings.

The preferred embodiment of this invention comprises a socket or electrical connector 2 for use in establishing electrical contact with traces on a single in-line memory module. A single in-line memory module is a high density assembly having components such as memory chips mounted on a circuit panel. The terminal 10 and socket 2 are suitable for establishing contact with traces having centerline spacings on the order of 0.050 inch or less. A typical embodiment could have sixty-four terminals 10 positioned side by side in an insulative housing 4. These terminals 10 can establish electrical contact with contact pads on both sides of a circuit panel substrate. These terminals can also be employed with circuit panels with traces located on only one side. The terminals 10 when mounted in socket housings 4 are connected to a printed circuit board in a conventional fashion. The single in-line memory modules can then be inserted edgewise into the sockets 2. Terminals 10 allow a low insertion force interconnection on closely spaced centerlines. A terminal suitable for use in the connector depicted herein is further disclosed in co-pending application Ser. No. 07/006,538 filed on Jan. 23, 1987.

Terminal

Each terminal 10 is edge stamped from a spring metal blank. The final configuration of each terminal is thus defined by a stamping operation and the terminal need not be subsequently formed into a contact shape. The width of each terminal is equal to the thickness of the blank stock thus allowing the terminals to be positioned on closely spaced centerlines. The preferred embodiment of terminals 10 are stamped from a spring metal such as phosphor bronze. Other conventional spring metals such as beryllium copper can also be employed. In the preferred embodiment of this invention, the terminals 10 are stamped from a phosphor bronze blank stock having a thickness of 0.012 inch.

Each terminal 10 comprises a pair of opposed cantilever beams 12, 12' extending upwardly from a base 14. A pair of insertion arms 16, 16' also extend from the base 14 laterally beyond the intersection of each cantilever beam 12, 12' with the base 14. A lead 18 extends downwardly from the base 14. In the preferred embodiment of this invention, the lead 18 comprises a through-hole lead suitable for soldered interconnection to a printed circuit board. Lead 18, however, could comprise a press fit lead suitable for a solderless interconnection to a plated through-hole on a printed circuit board or a surface mount lead. Lead 18 is offset from the center of the base 14. The centerline of lead 18 intersects base 14 at a point just slightly beyond the intersection of the centerline of the cantilever beam with the base 14.

Each cantilever beam comprises a first leg 20, 20' extending upwardly from the base 14 and a shorter second leg 22, 22' extending downwardly from the upper end of the cantilever beams 12 and 12'. The first legs 20, 20' are inclined relative to the base 14 and diverge laterally from the base to the upper end of the first legs 20, 20'. The first legs 20, 20' are joined to corresponding second legs 22, 22' at the upper end by curved transition sections 24, 24' so that each cantilever beam is inwardly reversely curved at its upper end. The second legs 22, 22' extend downwardly and are generally parallel to the upward extending first legs 20, 20'. Both first and second beams are generally the same width, except for a tapered section immediately adjacent the intersection of the first legs 20, 20' with the base 14.

The second legs 22, 22' project inwardly towards each other from the first legs 20, 20'. A flat inner edge 26, 26', extending downwardly from the curved transition portion 24, 24', forms a shallow ramp edge on each cantilever beam 12, 12'. These ramp edges 26, 26' extend at a shallow acute angle relative to a vertical axis perpendicular to the base 14. The flat ramp edges 26, 26' join a radiused contact crown surface 30, 30' at the lower end of the ramp sections. The radiused contact crown surfaces 30, 30' are the innermost sections of the respective contact arms and the cantilever beams 12, 12' are closed together at the radiused contact crowns 30, 30' than at any other point. In the preferred embodiment of the invention, the radiused contact crown surfaces 30, 30' are at the same height above the base 14. Lower lead sections 28, 28' extend from the radiused contact crown 30, 30' and diverge towards the ends of each cantilever beam.

Base 14 is generally straight and has an intermediate section 32 between the opposed cantilever beams 12, 12'. Cantilever beams 12, 12' and the intermediate base section 32 form a wrap around member engaging the opposite sides of a substrate inserted edgewise between the cantilever beams 12, 12'. The base 14 also includes laterally projecting sections 34, 34'. Insertion arms 16, 16' extend upwardly from the laterally projecting base sections 34, 34'. In the preferred embodiment of this invention, an insertion arm 16, 16' is therefore located laterally beyond each cantilever beam 12, 12'. The insertion arms 16, 16' are generally parallel to the first cantilever beam legs 20, 20' to which they are most closely adjacent. Cantilever beams 12, 12' are thus located inwardly of the insertion arms 16, 16' with the first cantilever beam legs 20, 20' being between the insertion arm 16, 16' and the second cantilever beam legs 22, 22'. Each insertion arm 16, 16' has an upper free end 36, 36'. In the preferred embodiment of this invention, the insertion arms 16, 16' extend upwardly to a point at which the free ends 36, 36' are above the radiused contact crown surfaces 30, 30'. Insertion arm free ends 36, 36' are also laterally beyond the outermost portion of cantilever beams 12, 12' and the insertion arm free ends 36, 36' are unobstructed when the terminal 10 is viewed from above.

Figure 6:
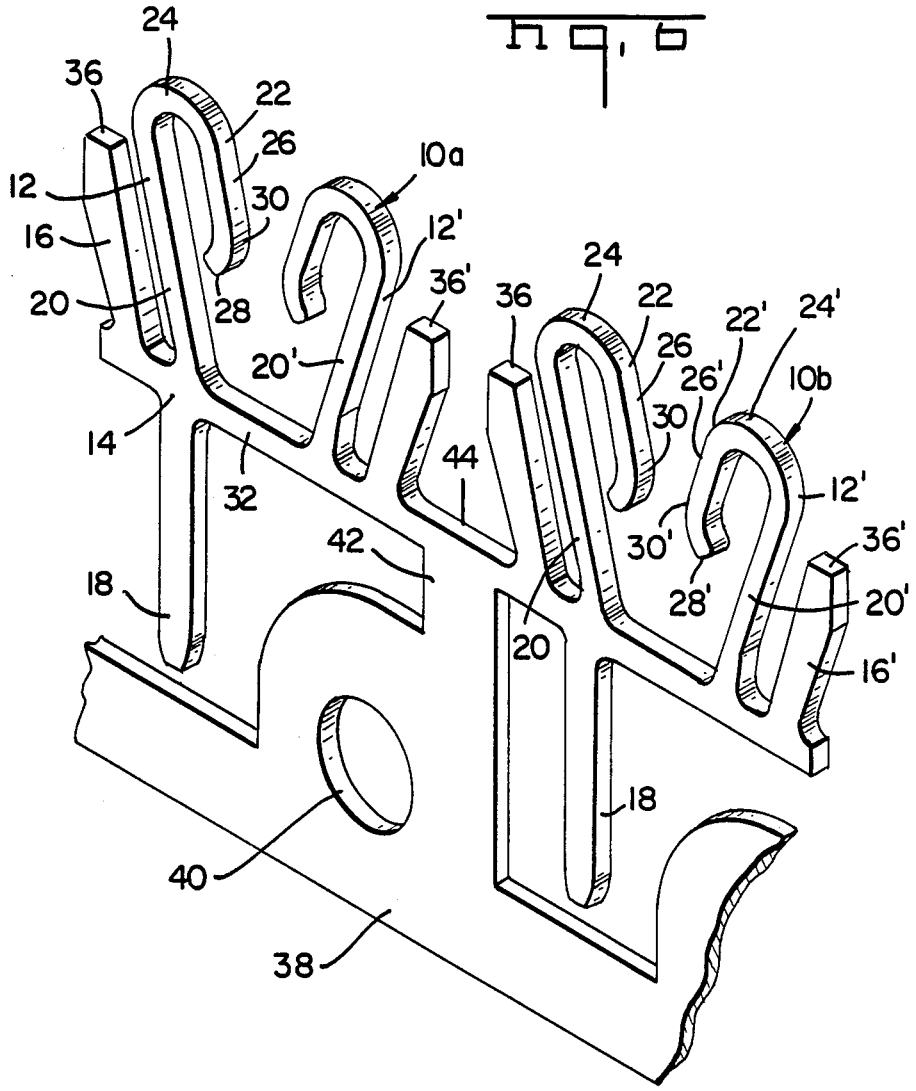
FIG. 6 is a view of the edge stamped contact terminals located on a integral carrier strip.
Figure 7:
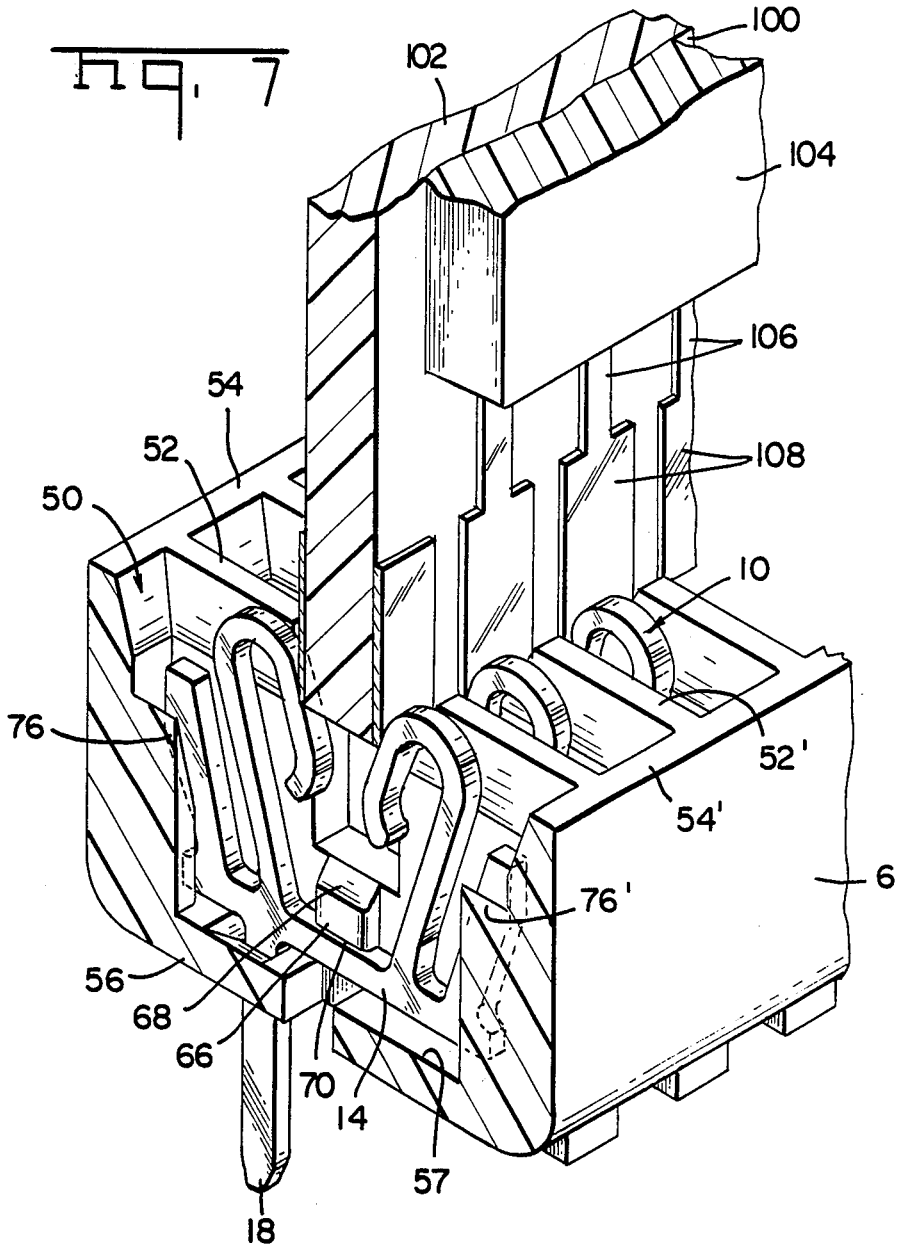
FIG. 7 is a perspective view, partially in section showing the initial engagement of a circuit panel with shallow ramp surfaces on opposed cantilever beams of the terminal.
Figure 8:
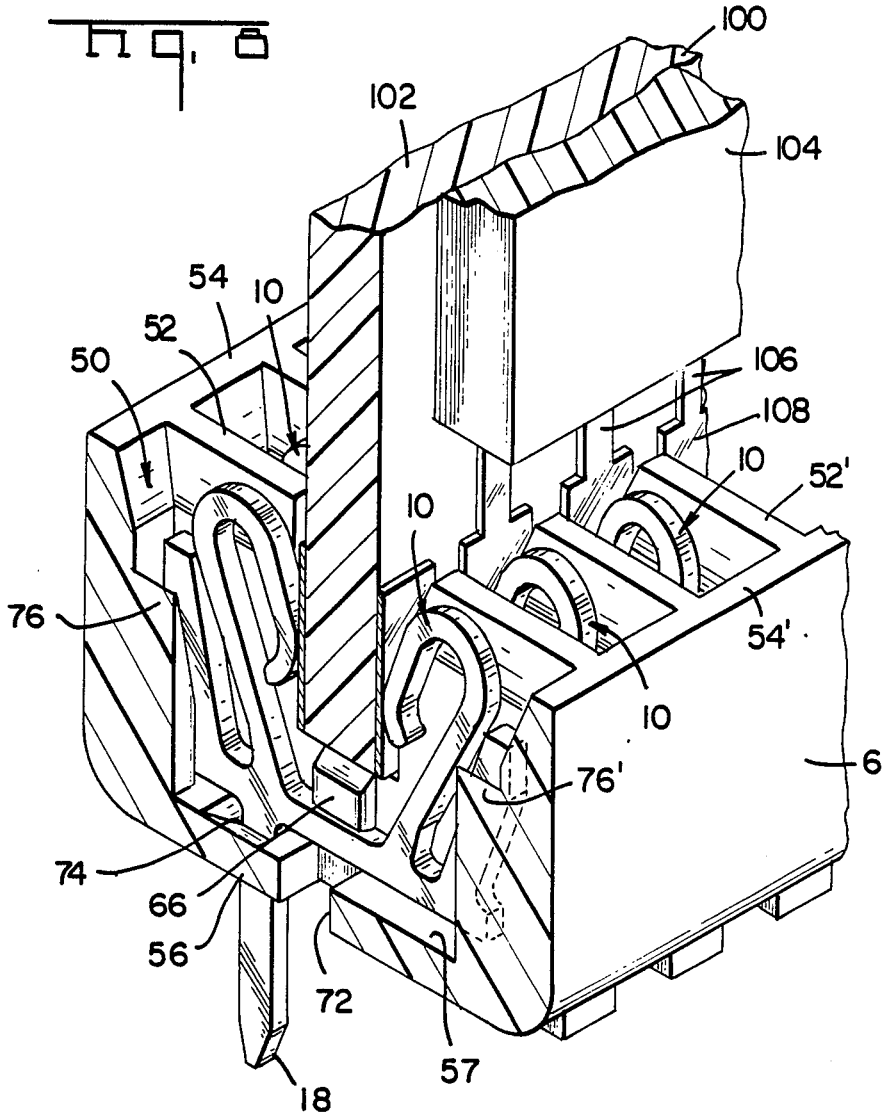
FIG. 8 is a view similar to FIG. 7 showing a fully inserted circuit panel assembly.

FIG. 6 shows that a plurality of terminals 10*a*, 10*b* can be continuously stamped on a flat blank which forms not only the terminal but a suitable carrier strip 38. Carrier strip 38 has spaced apart holes 40 which permit the carrier strip to be fed. A web 42 extends from the carrier strip and is connected to a section 44 between adjacent terminals 10*a*, 10*b*. Section 44 is generally in line with the base 14 of each terminal 10*a*, 10*b* and section 44 will be removed to separate terminal 10*a* from terminal 10*b* and separate both terminals from the carrier strip 38.

Cantilever beams 12, 12' are free to deflect independently of insertion arms 16, 16'. Upon the application of a force to the radiused contact surfaces 30, 30' the beams will be deflectable laterally outwardly with the primary stress in the terminal being in the plane of the edge stamped blank. Shear stresses will be developed in cantilever beams 12, 12' and in the intermediate base section 32. The shear stresses in the intermediate base section 32 will be greater than stresses in the laterally projecting base sections 34, 34'. Therefore, the insertion arms 16, 16' and the lead 18 will generally be attached to the base in areas where the shear stress due to deflection of the cantilever beams will not be significant.

Housing

The dielectric housing 4 depicted herein can be constructed of a conventional engineering plastic material suitable for use with electrical connectors. The housing 4 consists of a central body portion 6 extending between upright latching guides 8. Housing 4 is suitable for receiving a panel or printed circuit board inserted edgewise into the housing and provides means for positioning terminals 10 opening onto the upper surface of the central body 6.

The body 6 has a plurality of terminal receiving cavities 50 located side by side extending from one latching guide 8 to the opposite latching guide 8'. Each cavity 50 is open-ended along the upper surface 48 of the body 6. Each cavity is defined by parallel cavity walls 52 and endwalls 54. Each cavity has a floor 56 having a bottom surface 57. The cavities 50 extend transversely and across a central slot 60. The central portion of each of the walls 54 is cut out to define slot 60. The cut out portions of walls 54 are defined by inwardly facing opposed wall edges 62 and a slot shelf 64 defining the lower surface of the slot. The slot shelf 64 is spaced above the bottom surface 57 of cavities 50 and the walls 52 are continuous beneath the slot shelf 64. The portion of walls 52 flanking the central slot 60 comprise wall partitions 53, 53' which extend upwardly on opposite sides of slot 60.

One wall defining a cavity 50 has a centrally located protuberance 66 extending outwardly from the wall below the slot shelf 64. Protuberance 66 has an inclined upper surface 68 and a lower shoulder 70 which is generally perpendicular to the wall from which the protuberance extends. Each protuberance 66 is spaced from the opposite cavity wall by a distance at least equal to the thickness of terminals 10. A pair of ribs 76, 76' are located at the ends of the opposite walls defining each cavity 50. These ribs 76, 76' are positioned transversely beyond the protuberance 66 on opposite sides of slot 60. Each cavity 50 has two holes extending through the cavity floor 56. A centrally located access hole 72 is located immediately below the protuberance 66 and provides access for a core pin used to define the protuberance 66 when the housing is molded. Hole 72 also permits drainage of fluids which may accumulate in the socket. A lead hole 74 is offset from the central hole 72 and lead holes 74 in adjacent cavities 50 are located on opposite sides of the central access hole 72.

Latch guides 8, 8' located on opposite ends of the central body 6 each extend upwardly from the upper surface 48 of the body 6. The latch guides 8, 8' each have a guide slot 78, 78' extending to the upper surface thereof. Guide slot 78, 78' are aligned with the central slot 60 located in the body 6. A deflectable latch arm 80, 80' extends upwardly along one side of each of the guide slots 78, 78'. Latch arms 80, 80' are integrally formed on the housing 4. Each latch arm 80, 80' has a dowel 82, 82' located at its upper end. The latch arms 80, 80' are spaced from a recessed stop surface 84, 84' which extends from the base of the latch arm 80, 80' to the upper surface of the latching guides 8, 8'. The latching guides 8, 8' and the latch arms 80, 80' are more fully described in U.S. patent application Ser. No. 800,181 filed Nov. 20, 1985, incorporated herein by reference.

Terminals 10 located within cavities 50 are positioned in parallel side-by-side relationship. Since the terminals are edge stamped from a blank metal sheet, the terminals can be closely spaced. The cavities 50 of the multicontact insulative housing 4 are also relatively thin to permit close spacing between adjacent contacts. In the preferred embodiment of this invention, contacts can be spaced apart on centerlines of 0.050 inch. Closer spacings are possible.

Assembly

Figure 2:
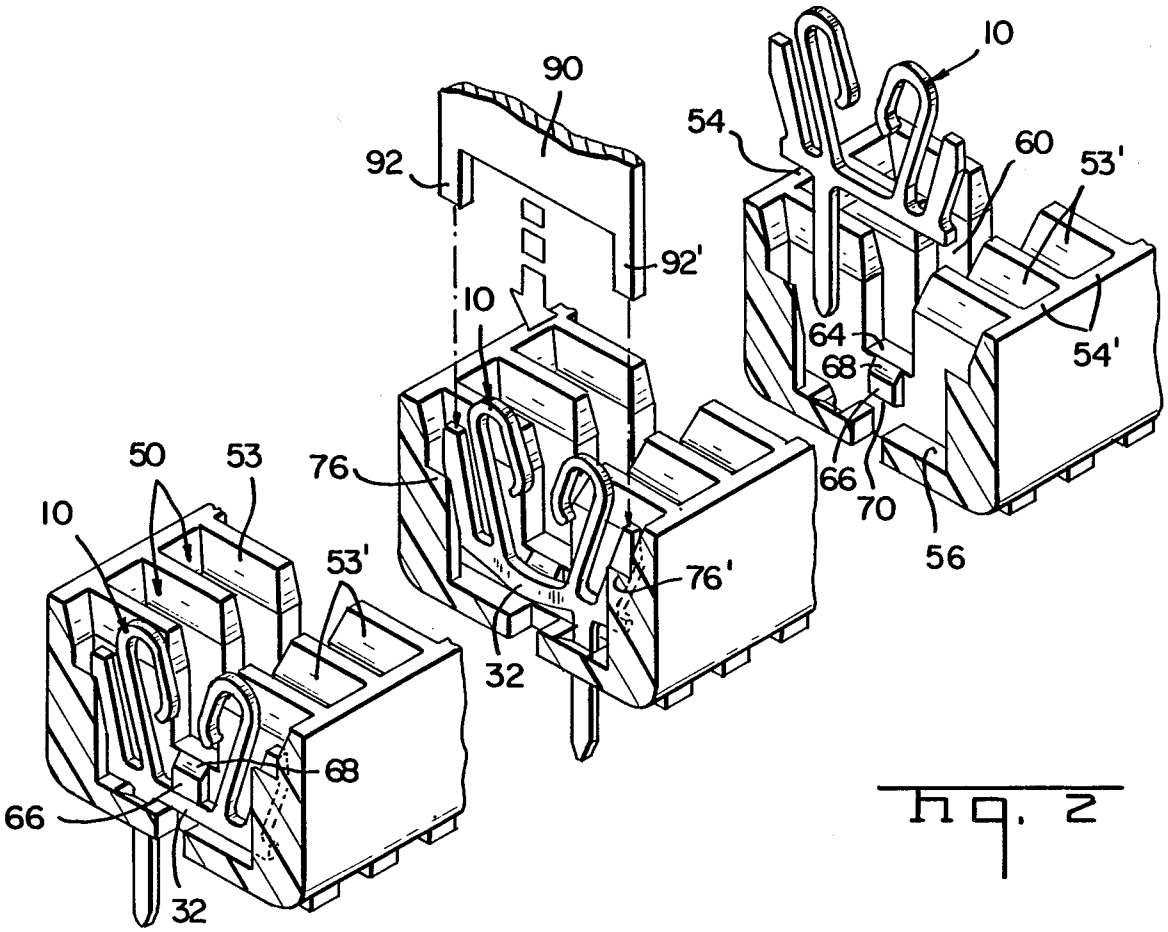
FIG. 2 is a perspective view in which portions of the housing are broken away to show the various stages of terminal insertion into the housing.
Figure 4:
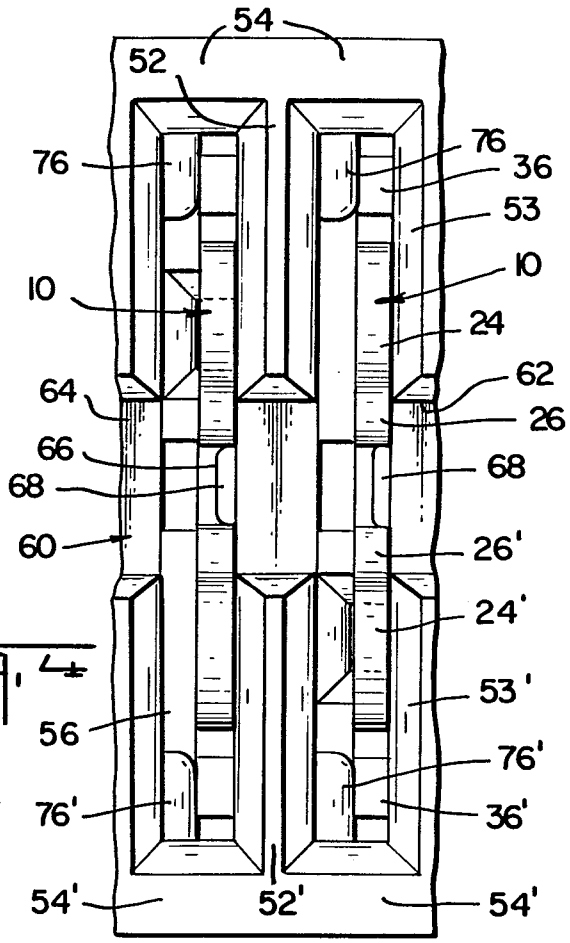
FIG. 4 is a view similar to FIG. 3 showing the terminals in place within the individual cavities.
Figure 5:
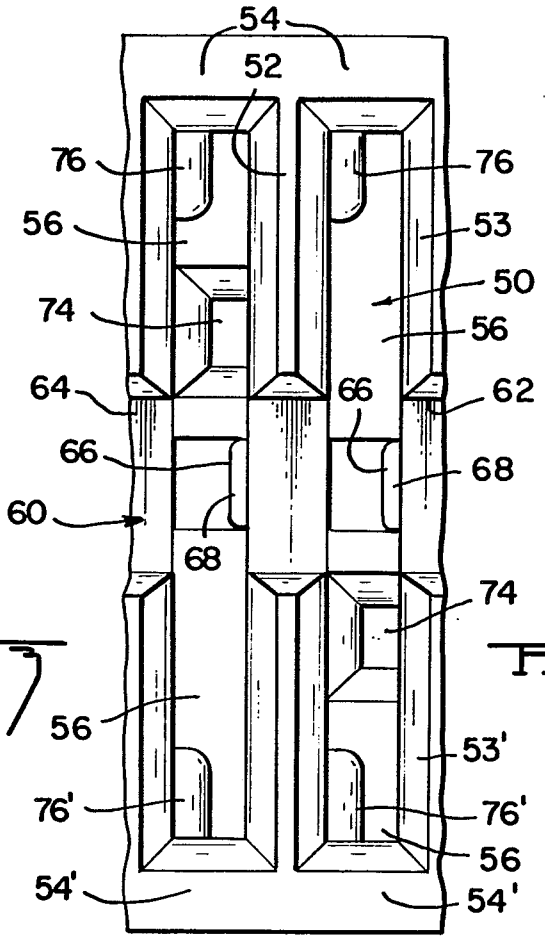
FIG. 5 is a sectional view taken along sections 5—5 showing the terminal in section located within a housing cavity.
Figure 5:
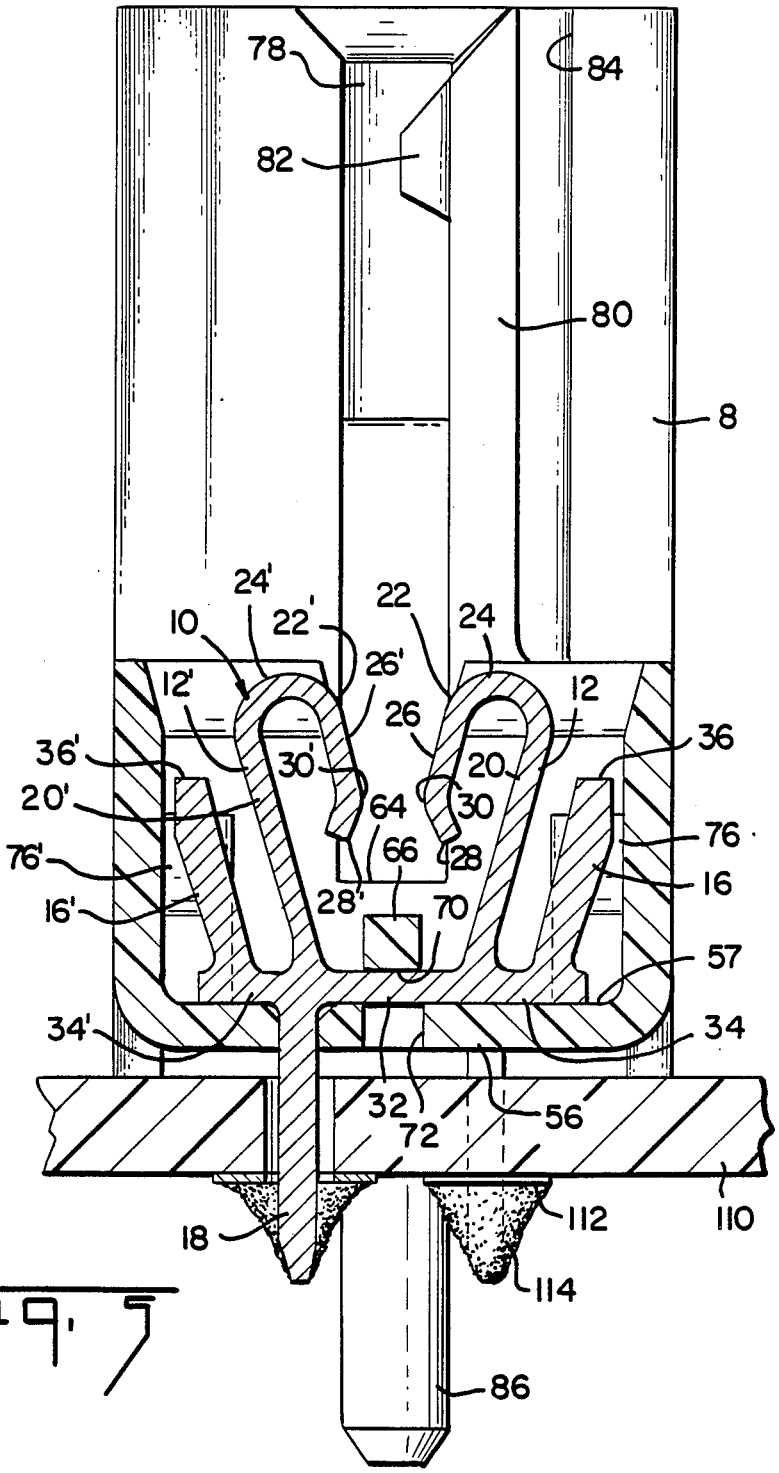

Terminals 10 are assembled into the body 6 of connector 2 by inserting the individual terminals into cavities 50 from above. Top loading of individual terminals is shown descriptively in FIG. 2. Individual terminals are first aligned with the appropriate cavity 50 with the leads 18 aligned with the staggered lead holes 74. Since the leads 18 are offset from the centerline of the terminals, the individual terminals 10 can be simply reversed to align leads 18 with the staggered holes 74 in adjacent cavities. In this manner, adjacent terminals with staggered leads can each have the same geometry.

An insertion tool, represented by the insertion head 90, can then be used to fully insert terminals 10 into cavities 50. Each insertion tool 90 has downwardly projecting rams 92, 92' at opposite ends. These rams 92, 92' are spaced apart by a sufficient distance such that the rams 92, 92' will engage the free ends 36, 36' of the insertion arms 16, 16'. Since the free ends 36, 36' are spaced upward from the terminal base 14, the insertion tool 90 and rams 92, 92' need not be inserted into cavities 50, to a significant depth. In the preferred embodiment of this invention, the insertion arm free ends 36, 36' extend above the radiused contact crown edges 30, 30'.

The clearance between the ribs 76, 76' and the opposite wall of individual cavities 50 is sufficient to receive the outermost portions of the laterally projecting base sections 34, 34' and the insertion arms 16, 16'. The intermediate base section 32, however, engages the inclined upper surface 68 of the protuberance 66 which extends from the cavity wall 52 opposite from the wall on which ribs 76, 76' are located. As insertion tool 90 forces the individual terminals 10 downward, the terminal is flexed causing the intermediate base section 32 to be bowed outwardly as this portion of the terminal passes over the protuberance 66. Continued downward movement of the terminals 10 brings the intermediate base section 32 of terminals 10 to a position below the protuberance 66. The flat lower shoulder 70 of each protuberance 66 is spaced upwardly from the bottom surface 57 of the cavity 54 by a distance at least equal to the height of the intermediate terminal base section 32. Therefore, when the individual terminals have been fully inserted, the intermediate base section 32 can snap back below the protuberance 66 and will be positioned between the flat lower shoulder 70 and the bottom surface 57 of the cavity floor 56. The intermediate base section 32, which forms an active part of the deflectable wrap-around contact, thus remains free to deflect when the terminal 10 is stressed. If a lance or other retention member were formed on intermediate base section 32, proper deflection of the wrap-around contact could be restricted. Individual terminals 10, inserted from above, will thus be held firmly in position within cavities 50. Since the leads 18 are offset, the terminals can simply be reversed upon assembly for a staggered lead configuration. Access hole 72 permits inspection to determine if intermediate base section 32 has snapped into place below protuberance 66.

Circuit Panel To Printed Circuit Board Interconnection

The connector 2 can comprise a socket for connecting a circuit panel 100 to a printed circuit board 110. In the preferred embodiment of this invention, the circuit panels 100 comprise one element of a module such as a single in-line memory module containing a plurality of active components such as dynamic RAMs on the circuit panel. Single in-line memory modules provide a space saving package for increasing the memory capacity which can be mounted onto a printed circuit board. The socket connector 2 depicted herein comprises a convenient means of interconnecting single in-line memory modules to a daughter board. Housings 4 containing terminals 10 with through-hole leads 18 can be wave soldered to printed circuit board daughter cards 110. Single in-line memory modules can then be plugged into the socket connectors.

In the preferred embodiment of this invention, the circuit panel 100 comprises a small printed circuit board substrate 102 on which the memory components 104 are mounted. This hybrid printed circuit board has traces 106 leading to the interconnection with the components 104. These traces 106 terminate in contact pads located on opposite sides at one edge of the substrate 102. In the preferred embodiment of this invention, the contact pads are spaced such that their centerlines are spaced apart by a distance of 0.050 inch. Thus, a large number of contact positions will be present on each circuit panel module. For example, sixty-four position modules having centerlines spaced apart by a distance of 0.050 inch could be employed with the socket connector of this invention. Although the preferred embodiment is intended to mate with contact pads 108 on opposite sides of the circuit panel 100, it should be understood that suitable contact could be established with a single side.

It will be appreciated that the amount of contact force generated for the insertion of high pin count modules of this type cannot be excessive if these modules are to be inserted using standard assembly equipment without damaging the modules. In the instant invention, the insertion forces are reduced to an acceptable level. The downwardly projecting second legs 22, 22' of the cantilever beams 12, 12' are positioned within cavities 50 such that at least a portion of ramp edges 26, 26' extend into the central panel receiving slot 60. These ramp edges 26, 26' are oriented at a shallow angle relative to the direction of insertion of the circuit panel 100. In other words, the ramp edges 26, 26' are located at a shallow angle relative to the direction of edgewise insertion of the circuit panel substrate 102. In the preferred embodiment of this invention, this angle is equal to approximately 15 degrees. The edges of the substrate 102 engage ramp edges 26, 26' between the curved transition section 24, 24' and the radiused contact crown surfaces 30, 30'. Continued insertion of the substrate 102 between cantilever beams 12, 12' causes the edge of the substrate 102 to move downward along ramp edges 26, 26' and deflect further. As the substrate 102 moves downward relative to cantilever beam 12, 12' the second leg 22, 22' deflects toward the first leg, 20, 20'. Furthermore, the first leg 20, 20' also deflects. The entire wrap around contact including cantilever beams 12, 12' and the intermediate base section 32 are subjected to shear stresses. In this manner, a relatively long edge stamped beam is deflected, thus reducing the insertion forces.

Eventually, the circuit panel 100 reaches a point where the radiused contact crown surfaces 30, 30', the innermost portion of cantilever beams 12, 12', engages the contact pad portion 108 of traces 106. The radiused contact crowns 30, 30' engage the contact pad portions 108 of traces 106 before the lower edge of substrate 102 engages the slot shelf 64. Continued downward movement of the circuit panel 100 relative to cantilever beams 12, 12', and therefore continued downward movement of the contact pad portion of traces 106 relative to the radiused contact crown surface 30, 30', results in a wiping action between the terminal and the pads on the surface of the panel. This wiping action results in the removal of contaminates and corrosion which would otherwise interfere with a satisfactory electrical contact.

The long stamped contact member, including the opposed cantilever beams 12, 12' and the intermediate base section 32, are all free to deflect when loaded by insertion of a circuit panel between the two cantilever beams 12, 12'. The stresses in this active contact member are relatively uniform, and no large stress buildup at any one point need be encountered.

This socket configuration is especially suitable for robotic insertion of a circuit panel. Straight line movements, without rotation of the circuit panel is all that is required for insertion. The circuit panel can be suitably keyed to the housing for alignment of the contact pads 108 with corresponding terminals 10.

Figure 9:
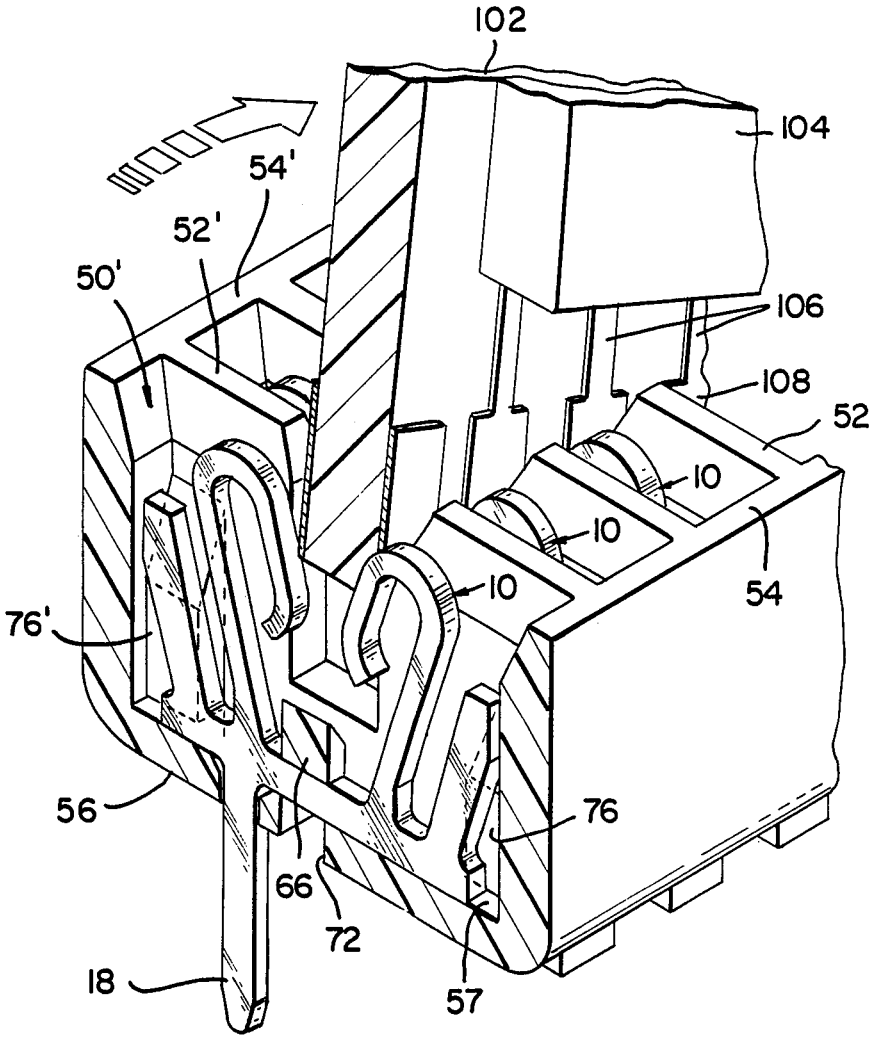
FIG. 9 is a view, in the opposite direction from FIGS. 7 and 8, illustrating, in exaggerated form, the progressive extraction or peeling of the circuit panel.

Removal of each circuit panel 100 can either be robotic or performed by hand. To reduce extraction force, the circuit panel 100 can be peeled out of the central slot 60 in the manner shown in FIG. 9, which is exaggerated for illustrative purposes. By removing one end of the circuit panel 100 before the other, the contact pads 108 can be progressively extracted from adjacent terminals 10, thus limiting the cumulative extraction force at any given instant during removal of the circuit panel. Lateral forces exerted on the individual terminals as a result of the peeling extraction, which might otherwise damage the terminals, are resisted because the terminals 10 are vertically stabilized within the cavities 50. This vertical stabilization is provided by the engagement of ribs 76, 76' with the insertion arms 16, 16' above the terminal base 14.

The following claims are directed to the connector employed herein. The preferred connector configuration is suitable for use in establishing a secure interconnection to surface pads on opposite sides of a circuit panel. This socket or connector is also suitable for low force insertions with terminals on close centerline spacings. The preferred embodiment employs a wrap-around terminal which can be inserted into the top of an insulative housing. However, the unique aspects of this terminal configuration can be employed in other embodiments which may not include each of these features. Therefore, each of the claims is not directed to configurations necessarily possessing the exact configuration of the preferred embodiment. Other embodiments and configurations, apparent to one skilled in the art, would also be within the scope of the following claims.

What is claimed:

1. An electrical connector for use in establishing electrical contact with traces on a circuit panel comprising:

an insulative housing having a circuit panel receiving slot, opening on an upper face, and a plurality of cavities opening on an upper face and defined by spaced apart walls, each cavity extending transversely across the centrally disposed circuit panel receiving slot; and a plurality of terminals insertable into the upper face of the cavities, each terminal comprising a base section and a pair of oppositely facing cantilever beams extending upwardly from the base, each cantilever beam being inwardly reversely curved at its upper end to form a downwardly extending ramp edge, the ramp edge extending at a shallow angle relative to an axis normal to the base, the ramp edge adjoining a radiused edge crown at the innermost projection of each cantilever beam, each radiused edge crown and a portion of each ramp edge extending into the slot when the cantilever beams are undeflected, whereby each beam is primarily stressed in the plane of the edge stamped spring metal blank upon insertion of a circuit panel between the cantilever beams.

2. An electrical connector for use in establishing electrical contact with traces on a circuit panel, comprising:

an insulative housing having at least one cavity defined by spaced apart walls projecting upwardly from the bottom surface of each cavity, each cavity extending transversely relative to means for receiving the circuit panel;

a protuberance extending outwardly from at least one wall of each cavity and spaced from the cavity bottom surface;

a terminal in each cavity, each terminal being edge stamped from a spring metal blank and comprising at least one cantilever beam, an edge of each cantilever beam extending beyond the cavity walls, each cantilever beam being deflectable in the plane of the terminal upon engagement of the edge of the terminal with the circuit panel; and a base on each terminal extending from each cantilever beam, the base being between the protuberance and the cavity bottom surface, the base being deflectable normal to the plane of the terminal to pass over the protuberance upon insertion of the terminal into the cavity from above.

3. The electrical connector of claim 2 comprising a multicontact connector in which the planes of adjacent terminals are parallel.

4. The electrical connector of claim 2 further comprising a pair of ribs extending from the cavity wall opposite the one wall from which the protuberance extends, each rib being disposed laterally of the protuberance, ends of the base being between the ribs and the one wall from which the protuberance extends.

5. The electrical connector of claim 2 wherein each terminal comprises two opposed cantilever beams projecting upwardly from an intermediate base.

6. The electrical connector of claim 5 wherein the means for receiving the circuit panel comprises a slot with each cavity extending on both sides of the slot, opposed cantilever beams being on opposite sides of the slot, the protuberance and the intermediate base extending below the slot.

7. The electrical connector of claim 6 wherein the terminal has a lead extending from the base and the bottom surface of each cavity has a hole, the lead being insertable through the hole upon insertion of the terminal into the cavity from above.

8. The electrical connector of claim 7 wherein the lead is offset on the terminal base.

9. The electrical connector of claim 8 wherein the holes in adjacent cavities of a multicontact connector are staggered on opposite sides of the slot, identical terminals being reversely inserted into adjacent cavities to stagger the leads.

10. An electrical connector for use in establishing electrical contact with traces on a circuit panel comprising:

an insulative housing having a circuit panel receiving slot, opening on an upper face, and a plurality of cavities opening on an upper face and defined by spaced apart walls, each cavity extending transversely across the centrally disposed circuit panel receiving slot; and a plurality of terminals insertable into the upper face of the cavities, each terminal having a pair of resilient cantilever beams extending upwardly from a terminal base, beams of each pair being on opposite sides of the centrally disposed circuit panel receiving slot, each beam having a contact surface extending into the slot, each terminal having a pair of insertion arms extending upwardly from the intermediate base, the cantilever beams of each terminal being between the insertion arms, whereby the terminals may be inserted into the cavities from above into a position to engage a circuit panel inserted edge-wise into the slot.

11. The electrical connector of claim 10 wherein each insertion arm has a free end located upwardly beyond the terminal contact surface.

12. The electrical connector of claim 10 further comprising a lead extending downwardly from the base, each housing cavity having a bottom surface with a lead opening extending through the cavity bottom surface, each lead extending through the lead opening.

13. The electrical connector of claim 10 further comprising a protuberance extending outwardly from one wall of each cavity, the protuberance engaging each terminal to retain the terminal in the cavity.

14. The electrical connector of claim 10 wherein adjacent terminals are spaced apart on centerline spacings no greater than 0.050 inch.

15. The electrical connector of claim 10 wherein each terminal is edge stamped from a spring metal blank, the cantilever beams being primarily stressed in the plane of the blank member upon insertion of the circuit panel into the slot.

16. The electrical connector of claim 15 wherein each contact surface comprises a radiused edge of one of the cantilever beams.

17. The electrical connector of claim 16 further comprising a ramp surface defined by an edge of each cantilever beam extending upwardly at a relatively shallow angle from the radiused edge contact surface, at least a portion of the ramp surface extending into the slot when the cantilever beams are undeflected.

18. The electrical connector of claim 10 wherein each cantilever beam comprises a first leg extending upwardly from the base and a second leg joined to the uppermost end of the first leg by a curved transition section, the second leg extending downwardly from the curved transition section.

19. The electrical connector of claim 18 wherein the second legs are positioned inwardly of the first legs on each terminal.

20. An electrical connector for use in establishing electrical contact with traces on a circuit panel, comprising:

an insulative housing having at least one cavity open on the housing upper surface and defined by first and second spaced apart walls projecting upwardly from the bottom surface of each cavity;

a central protuberance extending from a first wall of each cavity and spaced from the cavity bottom surface;

ribs disposed laterally of the central protuberance and extending from the second wall of each cavity; and a terminal insertable into each cavity from above the terminal having a base, the ends of the base being positioned between the ribs and the first wall, the center of the base being between the central protuberance and the bottom surface, the base being deflectable to pass over the protuberance upon insertion of the terminal into the cavity from above.

21. The electrical connector of claim 20 further comprising insertion arms extending upwardly from the terminal base adjacent the ends thereof, the insertion arms being at least partially between the ribs and the first wall and comprising means engageable with a separate insertion tool for inserting each terminal into a cavity from above.

22. The electrical connector of claim 20 further comprising a lead receiving opening in the bottom surface of each cavity and a lead on each terminal insertable into and through the lead receiving opening from above.

23. The electrical connector of claim 20 wherein the ribs engage the terminals above the base to stabilize the terminals within the cavities against forces normal to the plane of the terminals.

* * * * *